US005743219A

United States Patent [19]

Iio et al.

[11] Patent Number: 5,743,219

[45] Date of Patent: Apr. 28, 1998

[54] FOUR-STROKE-CYCLE V-TYPE ENGINE OF MOTORCYCLE

[75] Inventors: Hiroshi Iio, Hamamatsu; Hiroyuki Nakai, Shizuoka-ken, both of Japan

[73] Assignee: Suzuki Kabushiki Kaisha, Shizuoka-ken, Japan

[21] Appl. No.: 828,591

[22] Filed: Mar. 31, 1997

[30] Foreign Application Priority Data

Apr. 24, 1996 [JP] Japan ..... 8-102885

[51] Int. Cl.[6] ..... F02B 77/00

[52] U.S. Cl. ..... 123/54.4; 123/195 C

[58] Field of Search ..... 123/54.4, 195 C, 123/90.27, 198 E

[56] References Cited

U.S. PATENT DOCUMENTS

| | | | |
|---|---|---|---|
| 4,214,644 | 7/1980 | Matsuda | 123/54.4 |
| 4,230,074 | 10/1980 | Ichikawa et al. | 123/90.27 |
| 4,392,464 | 7/1983 | Woodward et al. | 123/196 R |
| 4,393,824 | 7/1983 | Fischer et al. | 123/196 R |
| 4,474,144 | 10/1984 | Tanaka et al. | 123/195 A |
| 4,497,293 | 2/1985 | Takagi et al. | 123/195 A |
| 4,534,322 | 8/1985 | Matsuda et al. | 123/195 R |
| 4,615,312 | 10/1986 | Tsumiyama | 123/90.27 |
| 4,617,882 | 10/1986 | Matsumoto | 123/195 A |
| 4,621,680 | 11/1986 | Funabashi | 123/41.57 |
| 4,637,654 | 1/1987 | Tominaga et al. | 123/195 R |
| 4,648,359 | 3/1987 | Ito | 123/90.31 |
| 4,671,216 | 6/1987 | Itoh | 123/198 E |
| 4,685,428 | 8/1987 | Inagaki et al. | 123/52.1 |
| 4,960,081 | 10/1990 | Atsuumi | 123/198 E |
| 5,199,395 | 4/1993 | Mizumura et al. | 123/196 A |
| 5,655,497 | 8/1997 | Nakajima | 123/198 E |

*Primary Examiner*—David A. Okonsky
*Attorney, Agent, or Firm*—Ronald P. Kananen

[57] ABSTRACT

A four-stroke-cycle engine of a motorcycle arranged between front and rear wheels thereof has a crank case in which a crank shaft is arranged and a plurality of cylinder assemblies operatively connected to the crank shaft and includes a front-side cylinder assembly and a rear-side cylinder assembly along a longitudinal direction of a motorcycle body. Each of the cylinder assemblies is composed of a cylinder block, a cylinder head mounted to a head portion of the cylinder block and a head cover covering the cylinder head. The cylinder assemblies are arranged so as to provide V-shapes along the longitudinal direction of the motorcycle body. A mating surface formed between the head cover and the cylinder head of at least the front-side cylinder assembly of the plural cylinder assemblies has an inclination obliquely downward towards the front wheel with respect to a mating surface formed between the cylinder head and the cylinder block of the front-side cylinder assembly.

3 Claims, 2 Drawing Sheets

FOUR-STROKE-CYCLE V-TYPE ENGINE OF MOTORCYCLE

BACKGROUND OF THE INVENTION

The present invention relates to a four-stroke-cycle V-type engine of a motorcycle and more particularly to a cylinder head of such engine in which cylinder blocks are arranged so as to provide a V-shape along the longitudinal direction, i.e. running direction, of a motorcycle body.

In some of known four-stroke-cycle engines in which a plurality of the valves are arranged for intaking an air/fuel mixture gas and exhausting an exhaust gas, there is an arrangement of an engine in which a plurality of cylinder blocks are arranged so as to provide a V-shape along the longitudinal or lateral direction of a motorcycle body. In the engine, the above-mentioned valves are arranged in head portions of the cylinder blocks and covered by head covers.

In such known arrangements, however, when a plurality of cylinder blocks are arranged in the longitudinal direction of the motorcycle body, an entire longitudinal length of the motorcycle body is made longer. Because of this arrangement, it becomes necessary to increase the wheel base so as to prevent the front wheel and front fender from contacting a cylinder head cover disposed in a front portion of the motorcycle body when the suspension for the front wheel is fully compressed, thus damaging maneuverability of the motorcycle.

In such arrangement in which the longitudinal dimension of the engine is increased, the distance between the crank shaft of the engine and the front wheel is also increased, resulting in the center of gravity of the engine being positioned relatively rearward, and hence, the load to be born to the front wheel is reduced, also affecting on the maneuverability of the motorcycle.

SUMMARY OF THE INVENTION

An object of the present invention is to substantially eliminate the defects or drawbacks encountered in the prior art and to provide a four-stroke-cycle V-type engine of a motorcycle arranged between front and rear wheels thereof, comprising a crank case in which a crank shaft is arranged and a plurality of cylinder assemblies operatively connected to the crank shaft including a front-side cylinder assembly and a rear-side cylinder assembly along a longitudinal direction of a motorcycle body. Each of the cylinder assemblies are composed of a cylinder block, a cylinder head mounted to a head portion of the cylinder block and a head cover covering the cylinder head. The cylinder assemblies being arranged so as to provide V-shapes along the longitudinal direction of the motorcycle body, wherein a mating surface formed between the head cover and the cylinder head of at least the front-side cylinder assembly of the plural cylinder assemblies has an inclination obliquely downward towards the front wheel side with respect to a mating surface formed between the cylinder head and the cylinder block of the front-side cylinder assembly.

The front-side cylinder assembly is disposed at a portion near the front wheel.

Furthermore, a mating surface may be designed to be disposed between the head cover and the cylinder head of the rear-side cylinder assembly of the plural cylinder assemblies so as to have an inclination obliquely downward towards the front wheel side with respect to a mating surface formed between the cylinder head and the cylinder block of the rear-side cylinder assembly.

According to the structure described above in which the cover-side mating surface on the front-side cylinder assembly is designed so as to provide an inclination obliquely downward towards the front wheel side with respect to the block-side mating surface, a space can be sufficiently ensured between the front-side head cover and the front wheel even when the suspension mechanism for the front wheel is fully compressed. Therefore, it is not necessary to extend the wheel base which would decrease the maneuverability of the motorcycle.

Furthermore, since the distance between the crank shaft of the engine and the front wheel can be shortened, the engine can be arranged properly so that the center of the gravity thereof can be shifted to a proper position to achieve the load balance to the front wheel, thus also improving the maneuverability of the motorcycle.

Still furthermore, according to the present invention, the cylinder heads can be made compact and light without damaging the function of a valve moving mechanism.

The nature and further features of the present invention will be made more clear from the following descriptions with reference to the accompanying drawings.

DESCRIPTION OF THE PREFERRED EMBODIMENT

Figure 1:
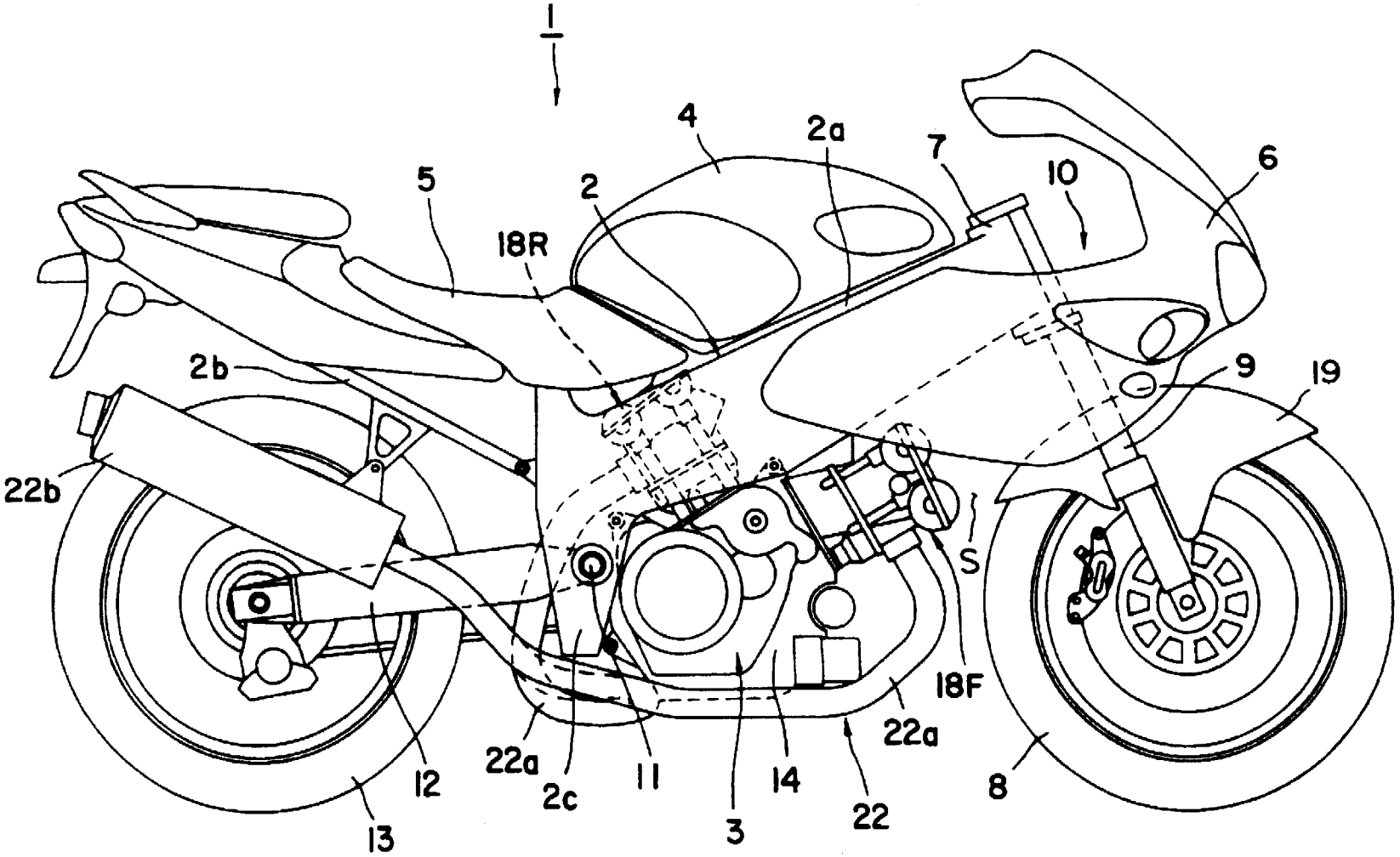
FIG. 1 is a side view of a motorcycle provided with a four-stroke-cycle V-type engine according to one embodiment of the present invention.

Referring to FIG. 1, a motorcycle 1 has a body frame 2 and an engine 3 mounted to a front lower portion of the body frame 2. A fuel tank 4 is disposed above the engine 3 and a rider's seat 5 is positioned behind the fuel tank 4. The front portion of the motorcycle 1 is covered by a cowling 6 to reduce air resistance to the motorcycle and to protect the rider from wind pressure during the running thereof.

A head pipe 7 is mounted to the front portion of the body frame 2. A steering assembly 10 including a pair of front forks 9 and front fenders 19, which are equipped with suspension mechanisms rotatably supporting the front wheel 8, is also mounted. The steering assembly 10 includes a handle bar, not shown.

The body frame 2 has, for example, a twin-tube type structure having a lateral pair of main frame elements **2*a* which are widened in the bilateral direction, i.e. width direction, of the motorcycle body at a portion immediately behind of the head pipe 7. Seat rails 2*b* extend rearward from substantially central portions of the main frame elements 2*a*, and pivot portions 2*c* are formed to the rear lower portions of the main frame elements 2*a***.

A pivot pin 11 is disposed laterally between the pivot portions **2*c*. A swing arm 12 is pivoted about the pivot pin 11 and a rear wheel 13** is supported to the swing arm by be rotatable.

Figure 2:
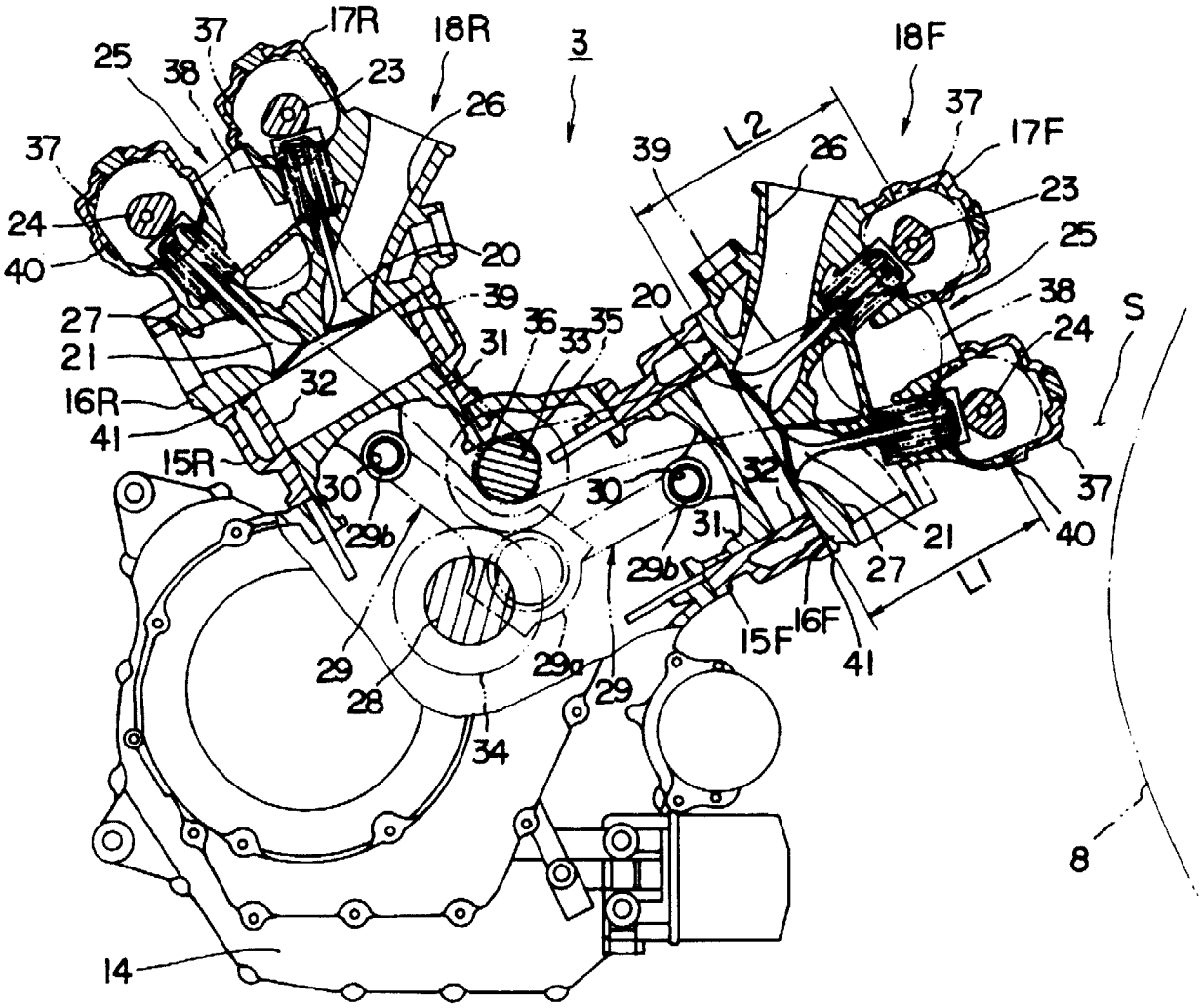
FIG. 2 is an elevational section, in an enlarged scale, of a cylinder arrangement of the V-type engine shown in FIG. 1.

As shown in FIGS. 1 and 2, the engine 3 comprises a crank case 14 and cylinder assemblies 18 composed of cylinder blocks 15, cylinder heads 16 and head covers 17, and in the present embodiment, two front and rear cylinder assemblies 18F and 18R are arranged so as to provide a V-shape structure in the longitudinal direction of the motorcycle body, i.e. running direction thereof. Further, in the present embodiment, the cylinder blocks 15 include two front and rear cylinder blocks 15F and 15R, the cylinder heads 16 includes two front and rear cylinder heads 16F and 16R and the head covers 17 includes two front and rear cylinder covers 17F and 17R, respectively.

The engine 3 is a four-stroke-cycle engine in which two camshafts 23 and 24 for intake and exhaust valves 20 and 21, respectively, are arranged on upper portions of the cylinder heads 16. Above these valves 20 21, and DOHC-type (double-overhead-camshaft) valve moving mechanisms 25 for opening or closing these valves 20 and 21 are also disposed.

Intake passages 26 are formed to a rear side of the front-side cylinder head 16F and a front side of the rear-side cylinder head 16R. An intake system, not shown, is connected to the intake passages 26. Exhaust passages 27 are also formed to a front side of the front-side cylinder head 16F and a rear side of the rear-side cylinder head 16R. Exhaust pipes **22*a* are connected to the exhaust passages 27, respectively, and then connected to a muffler 22*b*. The exhaust pipes 22*a* and the muffler 22*b*** constitute an engine exhaust system.

Inside the crank case 14, there is arranged a crank shaft 28 extending in a direction normal to the running direction of the motorcycle 1. Each of connection rods 29 has a large diameter end portion **29*a* coupled to the crank shaft 28 and has a small diameter end portion 29*b* coupled to a piston 31 through a piston pin 30. The piston 31 is disposed so as to reciprocate in a cylinder 32 formed to each of the cylinder blocks 16. The reciprocal stroke of the piston 31 is transmitted to the crank shaft 28 through the connection rod 29 to thereby rotate the crank shaft 28**.

An idler shaft 33 is arranged above the crank shaft 28 to be parallel thereto. A cam drive sprocket 34 is mounted to the crank shaft 28 and a cam driven sprocket 35 is also mounted to the idler shaft 33. The cam drive sprocket 34 and the cam driven sprocket 35 are operatively coupled to each other. An idler drive gear 36 is also mounted to the idler shaft 33.

The intake valves 20 and the intake camshafts 23 for opening or closing the intake valves 23 are disposed above the intake passages 26 of the front- and rear-side cylinder heads 16F and 16R, respectively, and the exhaust valves 21 and the exhaust camshafts 24 for opening or closing the exhaust valves 21 are also disposed above the exhaust passages 27 of the front- and rear-side cylinder heads 16F and 16R, respectively.

Cam sprockets 37 are mounted to respective ends of these camshafts 23 and 24, and the cam sprockets 37 are operatively coupled together through the idler driven gears 38 which are operatively connected to the idler drive gears 36 mounted to the idler shaft 33 by means of cam chains 39. According to such arrangement, when the crank shaft 28 is rotated, the rotating motion is transmitted to the camshafts 23 and 24 through the idler shaft 33. The valve moving mechanisms 25 is thereby driven.

The upper portions of the respective valve moving mechanisms 25 are covered by the front-side and rear-side head covers 17F and 17R. A mating surface 40 (cover-side mating surface) of the head cover 17F and the cylinder head 16F of the front-side cylinder assembly 18F has an inclination obliquely downward towards the front wheel side with respect to a mating surface 41 (block-side mating surface) of the cylinder head 16F and the cylinder block 15F. That is, in the present embodiment, a distance L1 between the cover-side mating surface 40 and the block-side mating surface 41 on the exhaust camshaft 24 side is designed to a value smaller than a distance L2 between the cover-side mating surface 40 and the block-side mating surface 41 on the intake camshaft 23 side. Further, it is to be noted that it is preferred to design the cover-side mating surface 40 of the rear-side cylinder assembly 18R with an inclination substantially the same as that of the front-side cylinder assembly 18F as mentioned above in a design matter and outer appearance.

The operation and function of the above embodiment will be described hereunder.

According to the structure in which the cover-side mating surface 40 on the front-side cylinder assembly 18F is designed so as to provide an inclination obliquely downward towards the front wheel 8 side with respect to the block-side mating surface 41, a space S can be sufficiently ensured between the front-side head cover 17F and the front wheel 18 even when the suspension mechanism for the front wheel 8 is fully compressed. Therefore, it is not necessary to extend the wheel base more than needed. The maneuverability of the motorcycle is therefore improved.

Furthermore, since the distance between the crank shaft 28 of the engine and the front wheel 8 is shortened, the engine 3 can be arranged properly so that the center of the gravity thereof can be shifted to a proper position to achieve the load balance to the front wheel 8, thus also improving the maneuverability of the motorcycle.

Still furthermore, according to the present invention, the cylinder heads 16 can be made compact and light without damaging the function of the valve moving mechanisms 25.

Further, it is to be noted that, in the present embodiment, a preferred example of two, i.e. front- and rear-side, cylinder assemblies is referred to, but the present invention will be applicable to an example of a V-type engine of a motorcycle having a plurality of, more than two, cylinder assemblies.

What is claimed is:

1. A four-stroke-cycle V-type engine of a motorcycle arranged between front and rear wheels thereof, comprising:

a crank case in which a crank shaft is arranged; and a plurality of cylinder assemblies operatively connected to the crank shaft and including a front-side cylinder assembly and a rear-side cylinder assembly along a longitudinal direction of a motorcycle body, each of the cylinder assemblies being composed of a cylinder block, a cylinder head mounted to a head portion of the cylinder block and a head cover covering the cylinder head, said cylinder assemblies being arranged so as to provide V-shapes along the longitudinal direction of the motorcycle body, wherein a mating surface formed between the head cover and the cylinder head of at least the front-side cylinder assembly of said plural cylinder assemblies has an inclination obliquely downward towards the front wheel with respect to a mating surface formed between the cylinder head and the cylinder block of the front-side cylinder assembly.

2. A four-stroke-cycle V-type engine according to claim 1, wherein said front-side cylinder assembly is disposed at a portion near the front wheel.

3. A four-stroke-cycle V-type engine according to claim 1 wherein a mating surface formed between the head cover and the cylinder head of the rear-side cylinder assembly of the plural cylinder assemblies has an inclination obliquely downward towards the front wheel side with respect to a mating surface formed between the cylinder head and the cylinder block of the rear-side cylinder assembly.

* * * * *